US005993727A

United States Patent [19]

Diederich et al.

[11] Patent Number: 5,993,727

[45] Date of Patent: Nov. 30, 1999

[54] FUME COLLECTING LADLE COVER

[75] Inventors: David J. Diederich; John C. Paddock, both of Avon Lake; Kenneth K. Krol, Lorain; Ralph Dybiec, North Royalton, all of Ohio

[73] Assignee: USS/KOBE Steel Company, Lorain, Ohio

[21] Appl. No.: 09/065,804

[22] Filed: Apr. 23, 1998

[51] Int. Cl.[6] ..... C21B 13/00

[52] U.S. Cl. ..... 266/44; 266/158

[58] Field of Search ..... 266/44, 158, 275, 266/287, 144, 159

[56] References Cited

U.S. PATENT DOCUMENTS

| | | | |
|---|---|---|---|
| D. 340,466 | 10/1993 | Simko | D15/144.1 |
| 429,337 | 6/1890 | Collin . | |
| 740,405 | 10/1903 | Dewhurst . | |
| 780,446 | 1/1905 | Richardson . | |
| 1,366,775 | 1/1921 | Farrier . | |
| 2,122,032 | 6/1938 | Goldberg et al. . | |
| 2,454,055 | 11/1948 | Gilchrist . | |
| 2,774,123 | 12/1956 | Reighart . | |
| 2,889,597 | 6/1959 | Griffiths . | |
| 3,055,316 | 9/1962 | Anderson et al. . | |
| 3,192,875 | 7/1965 | Kroeger et al. . | |
| 3,223,257 | 12/1965 | Kinkopf . | |
| 3,459,312 | 8/1969 | Britcher, Jr. et al. . | |
| 3,669,029 | 6/1972 | Lesk et al. . | |
| 3,717,331 | 2/1973 | Simons . | |
| 3,774,787 | 11/1973 | Ledinsky . | |
| 4,817,919 | 4/1989 | Mutschlechner et al. . | |
| 4,834,346 | 5/1989 | Heyer et al. . | |
| 4,878,551 | 11/1989 | Watkins et al. . | |
| 5,744,093 | 4/1998 | Davis | 266/158 |

*Primary Examiner*—Scott Kastler
*Attorney, Agent, or Firm*—Fay, Sharpe, Fagan, Minnich & McKee, LLP

[57] ABSTRACT

A metallurgical vessel cover having integral fume collection provisions is disclosed. The cover features a plurality of inlet openings defined about the perimeter of the cover that direct fumes or other gases residing around the exterior of the cover, through the interior of the cover, and to a single collection region. There, the fumes or gases are discharged through a shroud, which preferably is connected to an attachable venting duct. The cover also features an internal configuration for reducing heat transfer through the cover.

32 Claims, 7 Drawing Sheets

FUME COLLECTING LADLE COVER

BACKGROUND OF THE INVENTION

1. Field of the Invention

The present invention relates to a ladle cover for a metallurgical vessel. The cover has provisions for collecting fumes and vapors from the upper periphery of the vessel. The present invention finds particular application in the production and/or processing of leaded steel during which hazardous lead-containing fumes are typically emitted.

2. Description of Related Art

It is often desirable to access the contents of a covered metallurgical vessel, such as to introduce alloying elements, air, or other gases. Accordingly, prior artisans have provided covers with openings to accommodate such passage of materials. Collin illustrated a ladle cover having an upwardly extending member for the passage of air, and an opening for receiving and discharging metal in U.S. Pat. No. 429,337. Other aspects of modern vessel cover construction include a lightweight ladle lid design such as disclosed by Heyer et al. in U.S. Pat. No. 4,834,346. Lift brackets have also been provided for such covers, as illustrated by Reighart in U.S. Pat. No. 2,774,123.

During the production of particular alloyed metals, such as for example, leaded steel, hazardous fumes or vapors are often emitted from various components used in the production process. Efforts have been taken to collect such harmful fumes, such as described in U.S. Pat. No. 4,724,895 to Mulesa. Mulesa and other artisans have directed efforts to collecting fumes emitted during and after casting. That is, the prior art has primarily focused on collecting fumes emitted from components during and after casting molten material, such as leaded steel.

A significant amount of harmful, or potentially harmful, fumes may still escape from a metallurgical process prior to casting, even a process utilizing state of the art fume collection equipment. Accordingly, there is a need for a technique and associated hardware by which potentially harmful fumes, or at least a significant proportion of such fumes, may be collected from process components containing the molten metal prior to casting. More particularly, there is a need for a technique and related equipment for collecting hazardous fumes emitted from a metallurgical vessel, such as a ladle.

In addition to the foregoing, another concern in the design of a cover for a metallurgical vessel is minimizing heat loss through the cover. This is particularly significant for applications in which the vessel is a ladle utilized to receive molten metal. Prior artisans have incorporated heat resistant refractory materials along the underside of covers such as disclosed in U.S. Pat. No. 2,122,032 to Goldberg et al. Although satisfactory in most respects, it would be desirable to provide a vessel cover having improved heat retention qualities, i.e. relatively low rates of heat transfer through the cover.

SUMMARY OF THE INVENTION

The present invention provides in a first aspect, a ladle cover comprising (i) an upper planar member, the upper member defining a first aperture, (ii) a lower planar member spaced from the upper member, (iii) a sidewall extending between the upper member and the lower member, the sidewall defining a second aperture, and (iv) a heat insulating layer disposed proximate to the lower member. The upper and lower members and the sidewall define an interior cavity within the cover. Fumes are collected from around the exterior of the cover by applying a pressure differential across the first and second aperture in the sidewall, through the interior cavity, and exiting the cover through the first aperture.

In yet another aspect, the present invention provides a cover comprising (i) a first planar member defining a first aperture, (ii) a second planar member spaced from and generally parallel to the first planar member, (iii) a third planar member disposed between the first and the second planar members, (iv) a sidewall extending between the first and the second planar members, the sidewall defining a second aperture, and (v) a heat insulating layer disposed proximate to the second planar member. The first and third members define an interior fume collecting region. The third and second members define a secondary heat transfer barrier. Fumes are collected by applying a pressure differential across the first and second apertures, such as by applying a vacuum source to the first aperture.

In yet another aspect, the present invention provides a method for collecting fumes from a metallurgical vessel, the method comprising (i) providing a cover according to previously described aspects of the present invention, (ii) placing the cover over an open top of the vessel, and (iii) connecting a vacuum source to the cover, such as to the first aperture defined in the cover, whereby upon application of a vacuum or lower pressure source, fumes from the vessel are drawn through the cover to the vacuum source.

DESCRIPTION OF THE PREFERRED EMBODIMENT

In a preferred embodiment, the present invention provides a cover, such as for a metallurgical vessel, that includes fume collecting provisions as an integral part of the cover and a unique configuration for reducing heat transfer through the cover. Although the preferred embodiment cover is generally described to herein as a ladle cover, it is to be understood that the present invention includes a wide array of covers in addition to the noted ladle cover. Moreover, although the preferred embodiment cover is described herein as utilized in a leaded steelmaking process, it is to also be understood that the present invention cover can be employed in other processes or operations wherever it is desirable to collect flumes or gases from a container or vessel.

Figure 1:
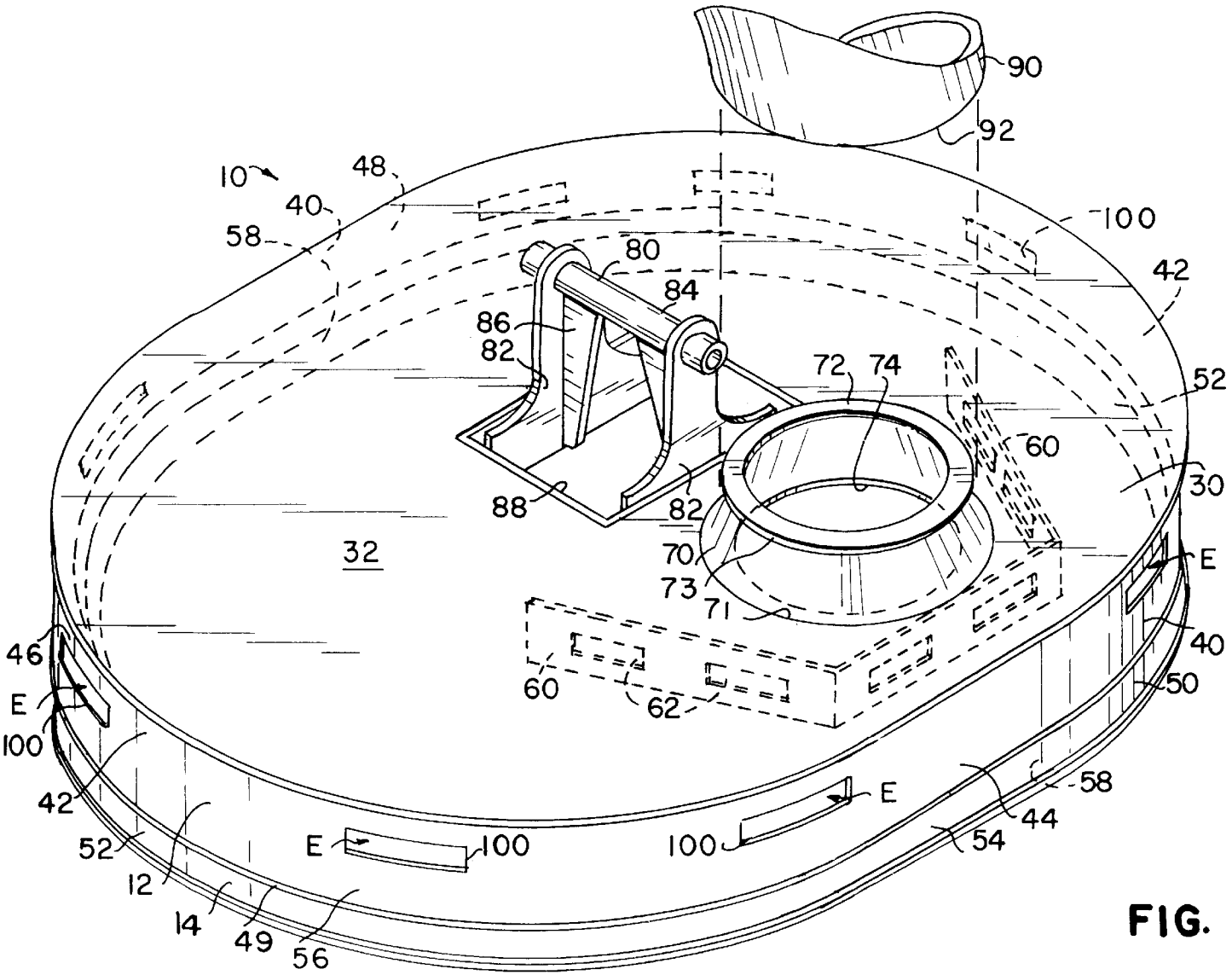
FIG. 1 is a perspective view of a preferred embodiment ladle cover in accordance with the present invention.
Figure 1A:
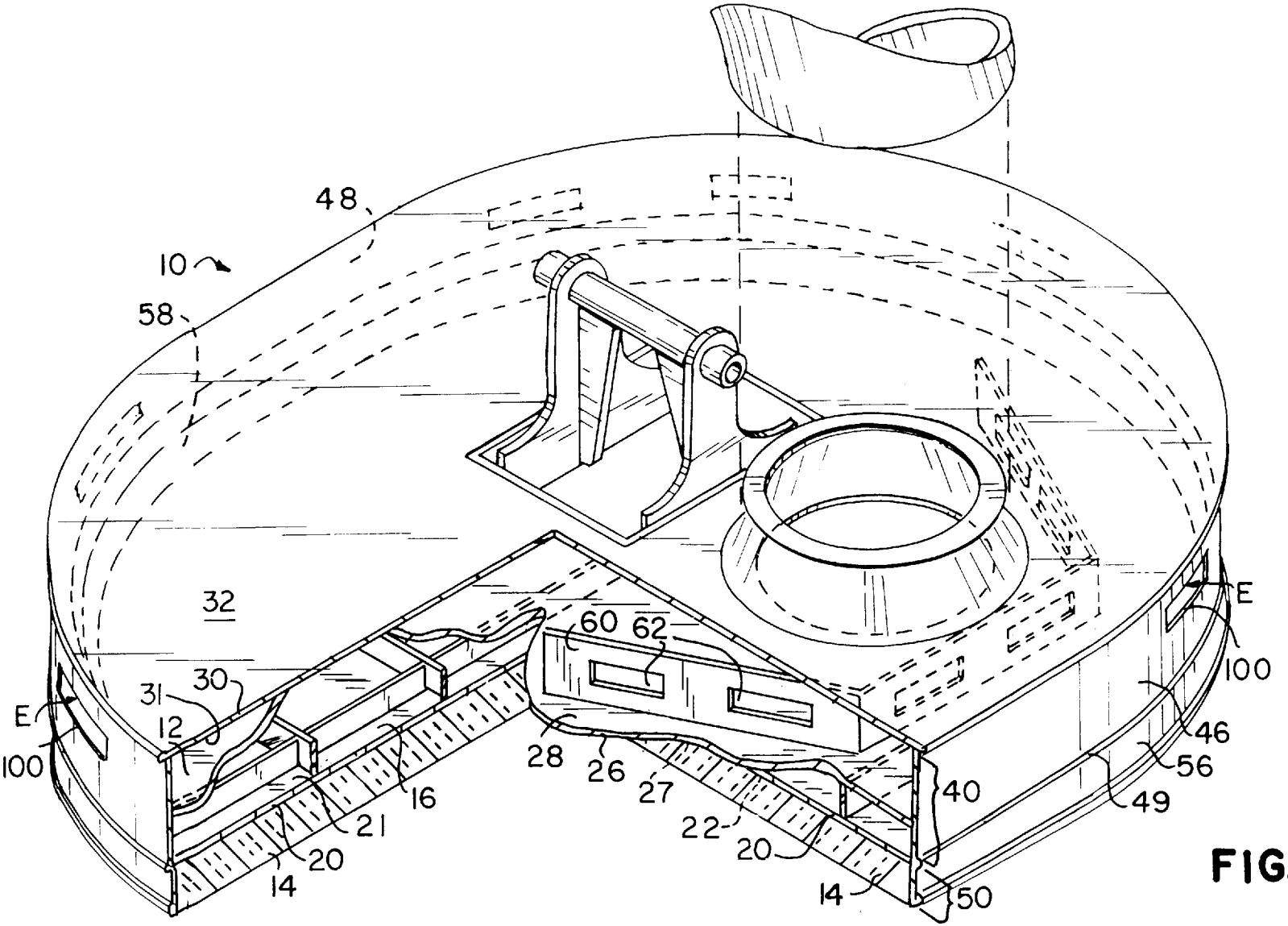
FIG. 1A is a partial sectional view of the preferred embodiment ladle cover illustrating the interior of the cover.

FIGS. 1 and 1A illustrate a preferred embodiment ladle cover 10 in accordance with the present invention. The preferred embodiment cover 10 comprises an upper planar member 30 and two planar members disposed within the interior of the cover 10 and spaced from, and generally parallel to, the upper planar member 30. A lower planar member 20 provides an inner face 21 directed toward the upper planar member 30, and an oppositely directed outer face 22. When the cover 10 is properly positioned on a ladle, the outer face 22 is directed toward the ladle and its contents. An interior planar member 26 is disposed between the lower planar member 20 and the upper planar member 30. The interior planar member 26 provides a lower face 27 directed toward the lower planar member 20 and specifically toward the inner face 21 of the lower member 20, and an upper face 28 directed toward the upper planar member 30 and specifically toward an inner face 31 of the upper member 30. The upper planar member 30 also provides an outer face 32 oppositely directed from the inner face 31. The lower, interior, and upper planar members, i.e. 20, 26 and 30, respectively, are generally oval-shaped when viewed in planar fashion. That is, each member has two hemi-circular shaped opposing ends and two straight opposing edges, generally parallel to each other, extending between the hemi-circular shaped ends.

Defined between the interior planar member 26 and the upper planar member 30, is a fume collecting region 12. A support bracket 60 is preferably disposed between the upper planar member 30 and the interior planar member 26. Most preferably, the bracket 60 contacts and is secured to both the inner face 31 of the upper member 30 and the upper face 28 of the interior member 26. One or more inlet apertures 62 are defined in the bracket 60 to promote the flow of air, fumes, or other gases within the fume collecting region 12. A heat insulating layer 14 is disposed proximate to the lower planar member 20. Most preferably, the heat insulating layer 14 is disposed alongside and immediately adjacent to the outer face 22 of the lower planar member 20. Also defined within the interior of the cover 10 is a secondary heat transfer barrier 16. This secondary barrier 16 is defined between the fume collecting region 12 and the heat insulating layer 14. These interior regions defined within the cover 10 are described in greater detail below.

The preferred embodiment cover 10 further comprises an upper and lower sidewall 40 and 50, respectively, extending around the periphery of the cover 10 as illustrated in FIGS. 1 and 1A. The upper sidewall 40 extends generally between the upper planar member 30 and the lower planar member 20. The lower sidewall 50 extends from the lower planar member 20 and specifically, away from the outer face 22 of the lower member 20. The lower sidewall 50 preferably extends to the exposed underside of the cover 10. The lower sidewall preferably extends from the lower planar member 20 a distance approximately equal to the thickness of the heat insulating layer 5. Preferably, the upper sidewall 40 extends transversely between the inner face 31 of the upper planar member 30 and the inner face 21 of the lower planar member 20. Accordingly, the upper sidewall 40 is preferably transversely oriented to the interior planar member 26.

It is preferred that the upper sidewall 40 be disposed along the peripheral or outer edge of the upper planar member 30. Accordingly, the upper sidewall 40 features arcuate portions 42 in which the sidewall 40 extends in a curved manner, and linear portions 44 in which the sidewall 40 extends in a straight manner. The arcuate portions 42 of the sidewall 40 extend alongside the hemi-circular ends of the upper member 30. The linear portions 44 of the sidewall 40 extend alongside the straight edges of the upper member 30. The arcuate portions 42 and the linear portions 44 of the upper sidewall 40 define a continuous outer face 46 and an oppositely directed inner face 48. Preferably, the lower sidewall 50 extends transversely from the lower planar member 20 and, specifically, away from the outer face 22. It is preferred that the lower sidewall 50 be disposed along the peripheral or outer edge of the lower planar member 20. Accordingly, the lower sidewall 50 features arcuate portions 52 in which the sidewall 50 extends in a curved manner, and linear portions 54 in which the sidewall 50 extends in a straight manner. The arcuate portions 52 of the sidewall 50 extend alongside the hemi-circular ends of the lower planar member 20. The linear portions 54 of the sidewall 50 extend alongside the straight edges of the lower planar member 20. The arcuate portions 52 and the linear portions 54 of the lower sidewall 50 define a continuous outer face 56 and an oppositely directed inner face 58.

It is most preferred that the span between a first linear portion 54 and a second opposite linear portion 54 on the other side of the lower planar member 20 is less than the distance between a first linear portion 44 and a second opposite linear portion 44 on the other side of the upper planar member 30. Similarly, it is most preferred that the distance between an arcuate portion 52 on one end of the lower planar member 20 and an opposite arcuate portion 52 on the other end of the lower planar member 20 is less than the span between an arcuate portion 42 on one end of the upper planar member 30 and an opposite arcuate portion 42 on the other end of the upper planar member 30. This configuration results in a recessed lip 49 extending around the outer periphery of the cover 10 generally separating the sidewalls 40 and 50.

The preferred embodiment cover 10 also comprises a lift bracket 80 extending outwardly generally from the upper planar member 30. The lift bracket 80 preferably extends away from the outer face 32 of the upper planar member 30. The lift bracket 80 is preferably disposed and positioned directly over the center of gravity of the cover 10. As will be understood, such placement prevents or significantly minimizes the tendency of the cover to assume an angled or tilted orientation upon lifting at the lift bracket 80. Although the lift bracket 80 may be provided in a wide array of configurations, it is preferred that it include at least two support legs 82 and a transverse member 84 extending between the legs 82 and spaced from the outer face 32 of the upper planar member 30. The lift bracket 80 may also include one or more strengthening members 86 extending between and affixed to the support legs 82 and the transverse member 84. The lift bracket 80 is preferably disposed within an upper bracket aperture 88 defined within the upper planar member 30. Most preferably, the lift bracket 80 is also disposed within an inner bracket aperture (not shown) defined within the interior planar member 26. As described in greater detail below, the lift bracket 80 is affixed to one or both the interior planar member 26 and the lower planar member 20. The lift bracket 80 is also preferably affixed to the upper planar member 30. This configuration provides greater adherence and affixment between the lift bracket 80 and the cover 10.

The upper planar member 30 also defines a shroud opening 74 defined in the upper planar member 30. The opening 74 is sized to receive, accommodate, or otherwise function with a shroud 70 outwardly extending from the upper planar member 30. The shroud 70 is preferably frusto-conical in shape having a base 71 adjacent to or in contact with the outer face 32 of the upper planar member 30, and a distal end 73 disposed above and spaced from the outer face 32 of the upper planar member 30. Most preferably, both the base 71 and the distal end 73 are circular in cross-section. The base 71 preferably has a diameter greater than the diameter of the distal end 73, thereby resulting in the preferred frusto-conical configuration of the shroud 70. A collar 72 preferably extends around the distal end 73.

As previously noted, the preferred embodiment cover 10 provides an interior region 12 for the collection and passage of fumes therethrough. Referring to FIGS. 1 and 1A, the cover 10 further comprises a plurality of inlet openings 100 defined in the sidewall, and specifically in the upper sidewall 40 between the upper planar member 30 and the interior planar member 26. The inlet openings 100 are generally spaced about the perimeter of the cover 10. The inlet openings 100 serve to allow fumes or other gases to be drawn or otherwise transferred from along the exterior of the cover 10, such as along the outer faces 46 and 56 of the upper and lower sidewalls 40 and 50, respectively, through the fume collecting region 12 defined within the interior of the cover 10, to the shroud 70. The fumes are withdrawn, or airflow generated by, connecting an attachable venting duct 90 to the shroud 70.

The attachable venting duct 90 is of the type typically used in refineries or metalworking facilities. The venting duct 90 may be part of a moveable exhaust hood known in the art. The venting duct 90 has a distal end 92 that is connectable or otherwise engageable with the shroud 70. Preferably, the distal end 92 of the venting duct 90 sealingly attaches to the collar 72 provided on the shroud 70. It will be understood that any vacuum source capable of producing a pressure differential causing airflow to the vacuum source may be utilized to draw fumes through the cover.

Figure 2:
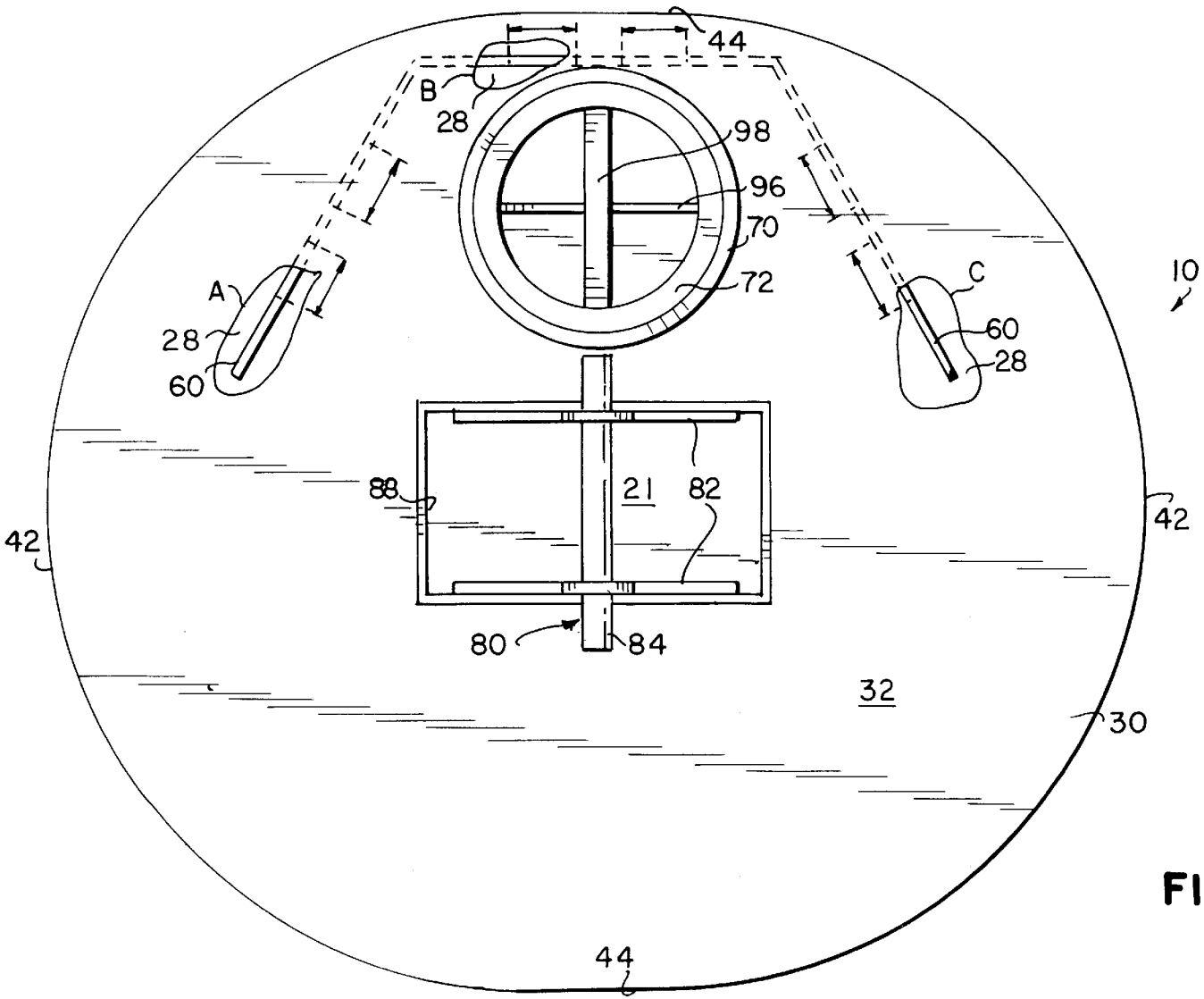
FIG. 2 is a planar view illustrating the top of the preferred embodiment ladle cover, the top being partially removed to reveal an interior fume collecting region within the cover.

The interior configuration and construction of the preferred embodiment cover 10 is as follows. Referring to FIG. 2, a top view of the preferred embodiment cover 10, the upper planar member 30 and, specifically, its outer face 32, is illustrated. The upper planar member 30 is depicted in FIG. 2 as having cut-away or removed sections A, B, and C to reveal the support bracket 60 disposed within the fume collecting region 12. As previously noted, the bracket 60 is positioned between the upper planar member 30 and the interior planar member 26. Accordingly, portions of the upper face 28 of the interior planar member 26 are also revealed at cut-away sections A, B, and C. In the event that the lift bracket 80 extends from the lower planar member 20 through both the interior planar member 26, i.e. through the inner bracket aperture defined in the interior member 26, and the upper planar member 30, i.e. through the upper bracket aperture 88, a portion of the inner face 21 of the lower planar member 20 is viewable through the apertures.

Figure 3:
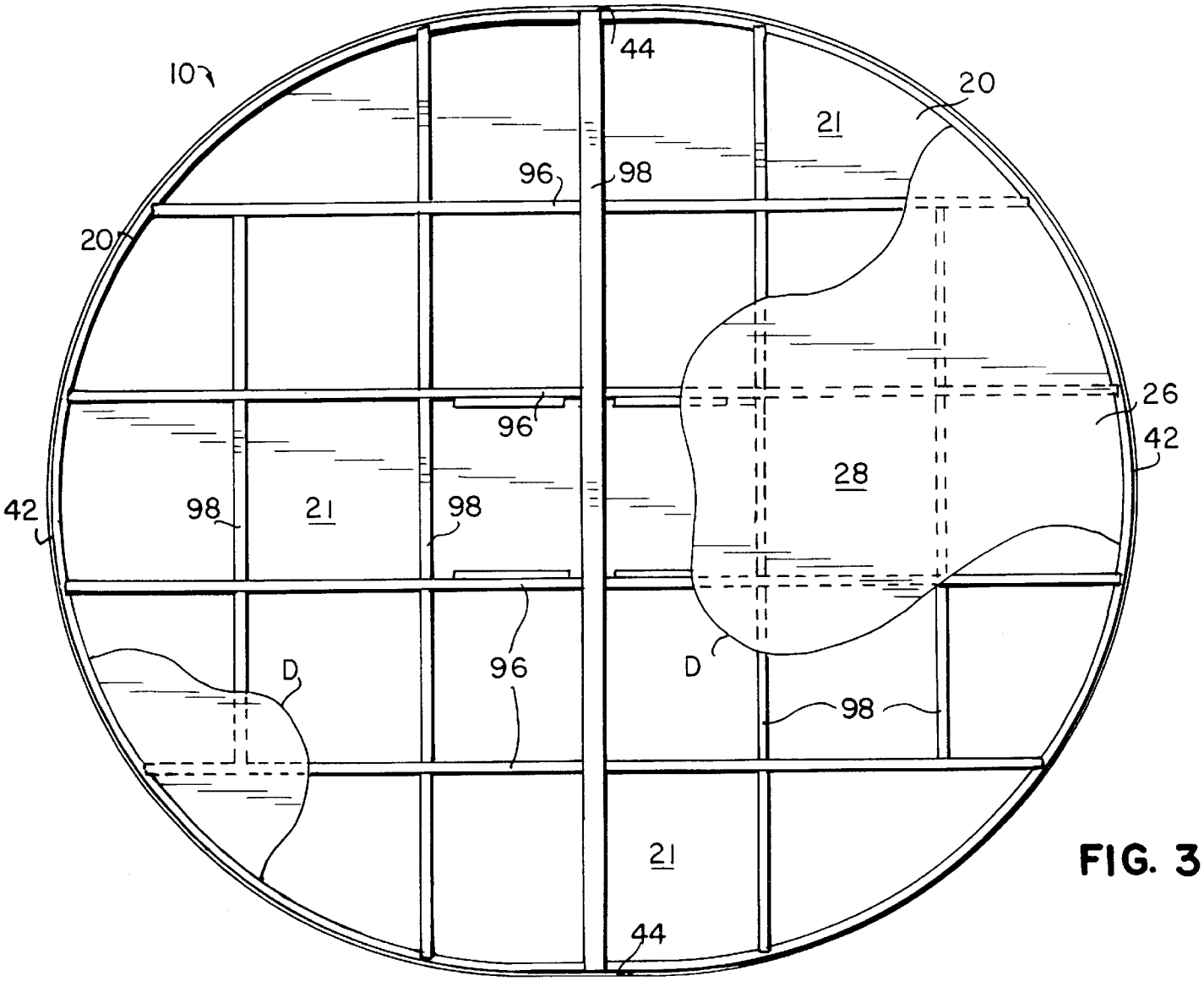
FIG. 3 is a planar view illustrating the top of the preferred embodiment ladle cover, the top being entirely removed and an interior member being partially removed to reveal an interior heat insulating layer within the cover.

The preferred embodiment cover 10 also comprises a plurality of internal strengthening and support ribs disposed within the interior of the cover 10. These ribs are disposed within the secondary heat transfer barrier 16 described in greater detail below. These ribs are illustrated in FIG. 3, and also in previously described in FIGS. 1A and 2. FIG. 3 is a view of the cover 10, similar to that of FIG. 2, however, the upper planar member 30, the lift bracket 80, the shroud 70, the support bracket 60, and a portion of the interior planar member 26 removed at section D, are all removed to reveal the plurality of ribs and the lower planar member 20. The ribs comprise an array of major ribs 96 extending between the hemi-circular opposing ends of the cover 10, such as between arcuate portions 42 of the upper sidewall 40. The major ribs 96 are most preferably equally spaced from one another, or substantially so, and generally parallel to each other. The ribs also include an array of minor ribs 98, at least some extending between the straight opposing edges of the cover 10, such as the linear portions 44 of the upper sidewall 40. The minor ribs 98 are most preferably spaced from one another, or substantially so, and generally parallel to each other. As evident in FIG. 3, it is preferred that each of the major ribs 96 is oriented perpendicularly to each of the minor ribs 98. It is also preferred that the minor rib 98 disposed generally within the middle or center of the cover 10 have a greater thickness and/or width dimension than the other minor ribs 98 to provide additional strength and rigidity to the cover 10.

Figure 4:
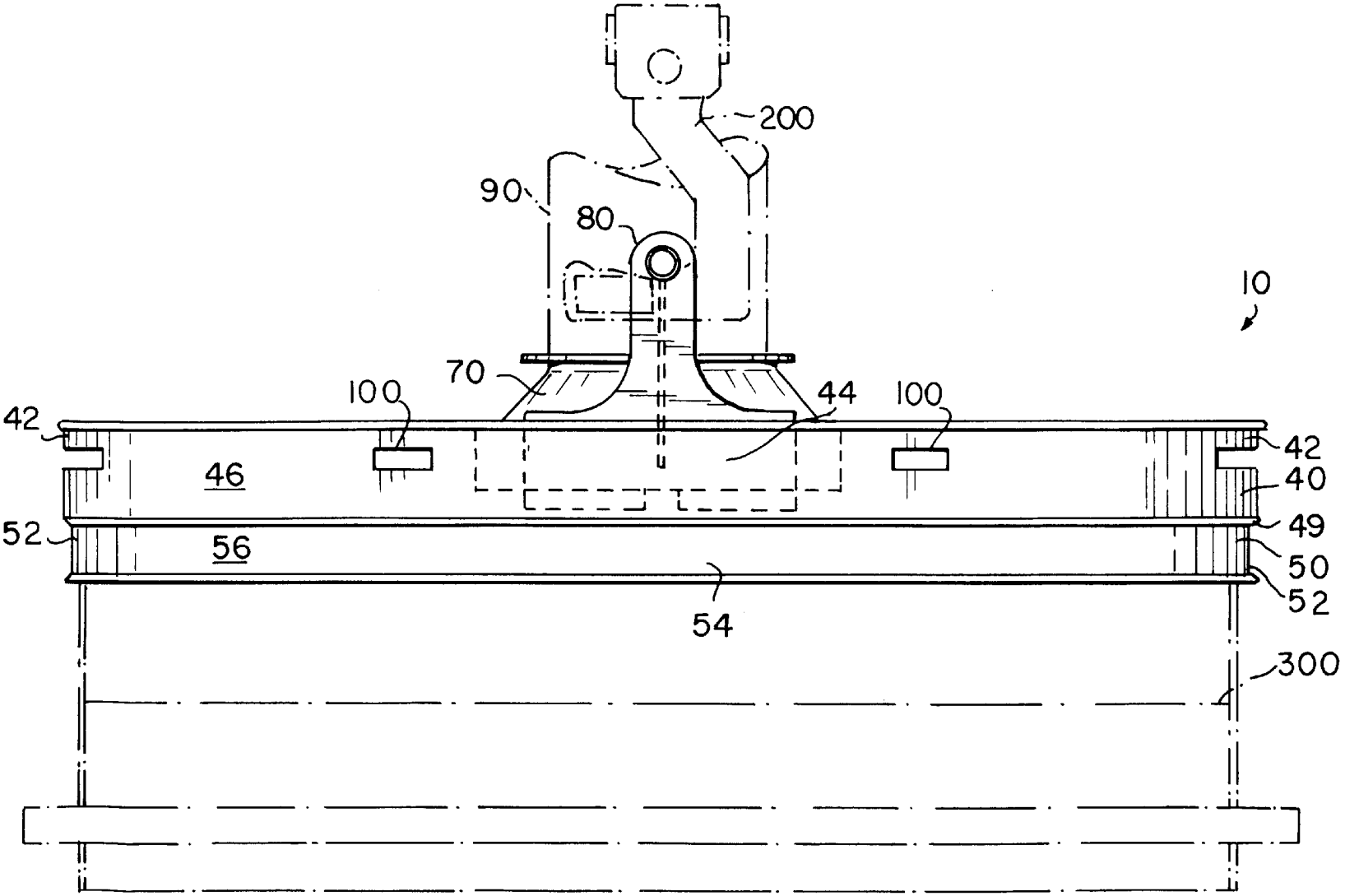
FIG. 4 is an elevational view of the side of the preferred embodiment cover and its engagement with a ladle or other metallurgical vessel (shown in phantom), a lifting hook (in phantom), and a venting duct (in phantom)
Figure 5:
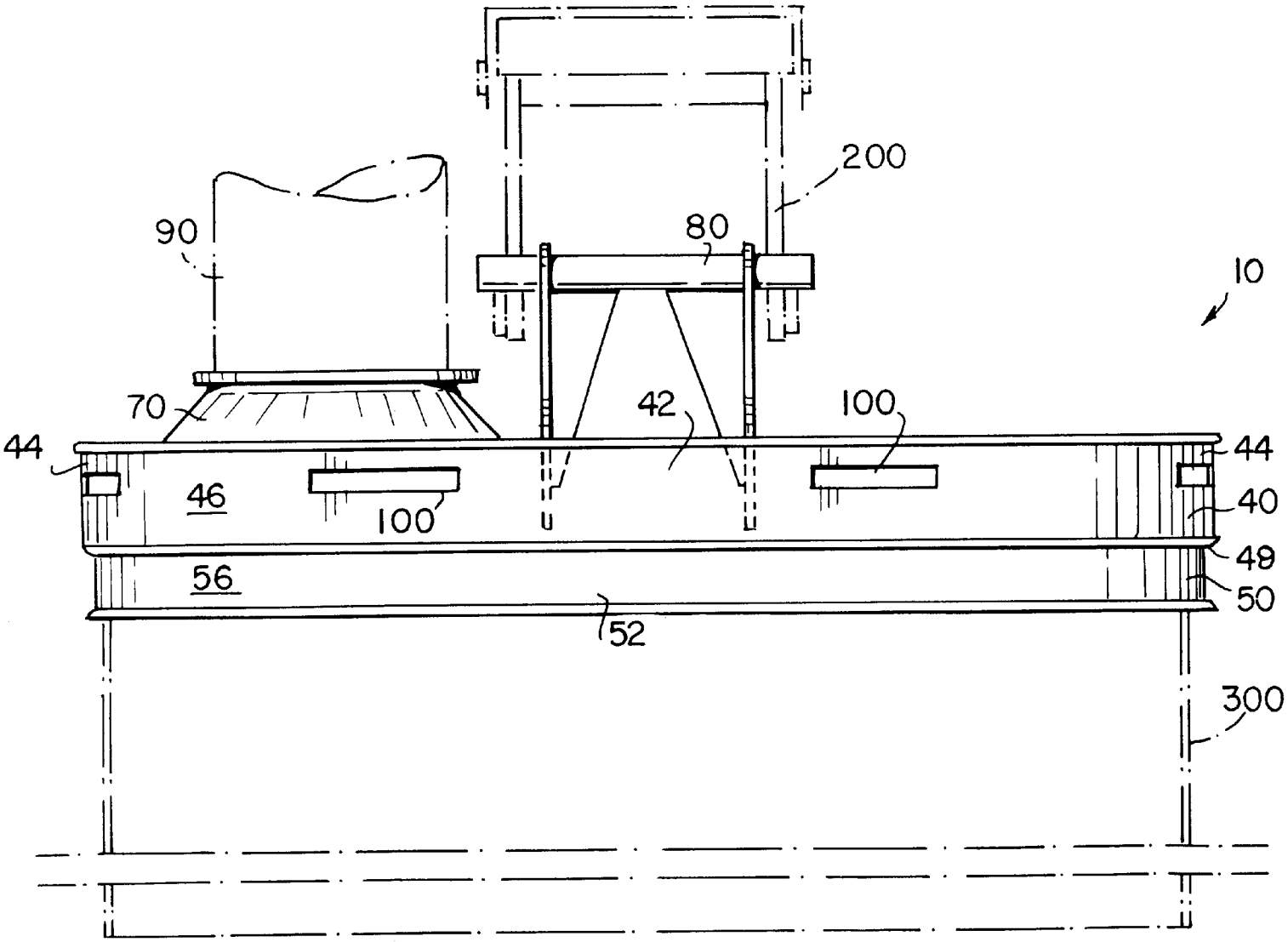
FIG. 5 is an elevational view of another side, at right angles from the viewpoint of FIG. 4, of the preferred embodiment cover and its engagement with a ladle (in phantom), a lifting hook (in phantom), and a venting duct (in phantom)

FIGS. 4 and 5 illustrate the preferred embodiment ladle cover 10 disposed upon and covering a typical ladle 300 (depicted in phantom).

The cover 10 is also illustrated as engaged with a venting duct 90 (also shown in phantom) and a lifting hook 200 (in phantom). It will be appreciated that the preferred embodiment cover 10 is used in conjunction with a metallurgical vessel, such as the ladle 300, having a generally open top region from which fumes, to be collected, are emitted.

Figure 6:
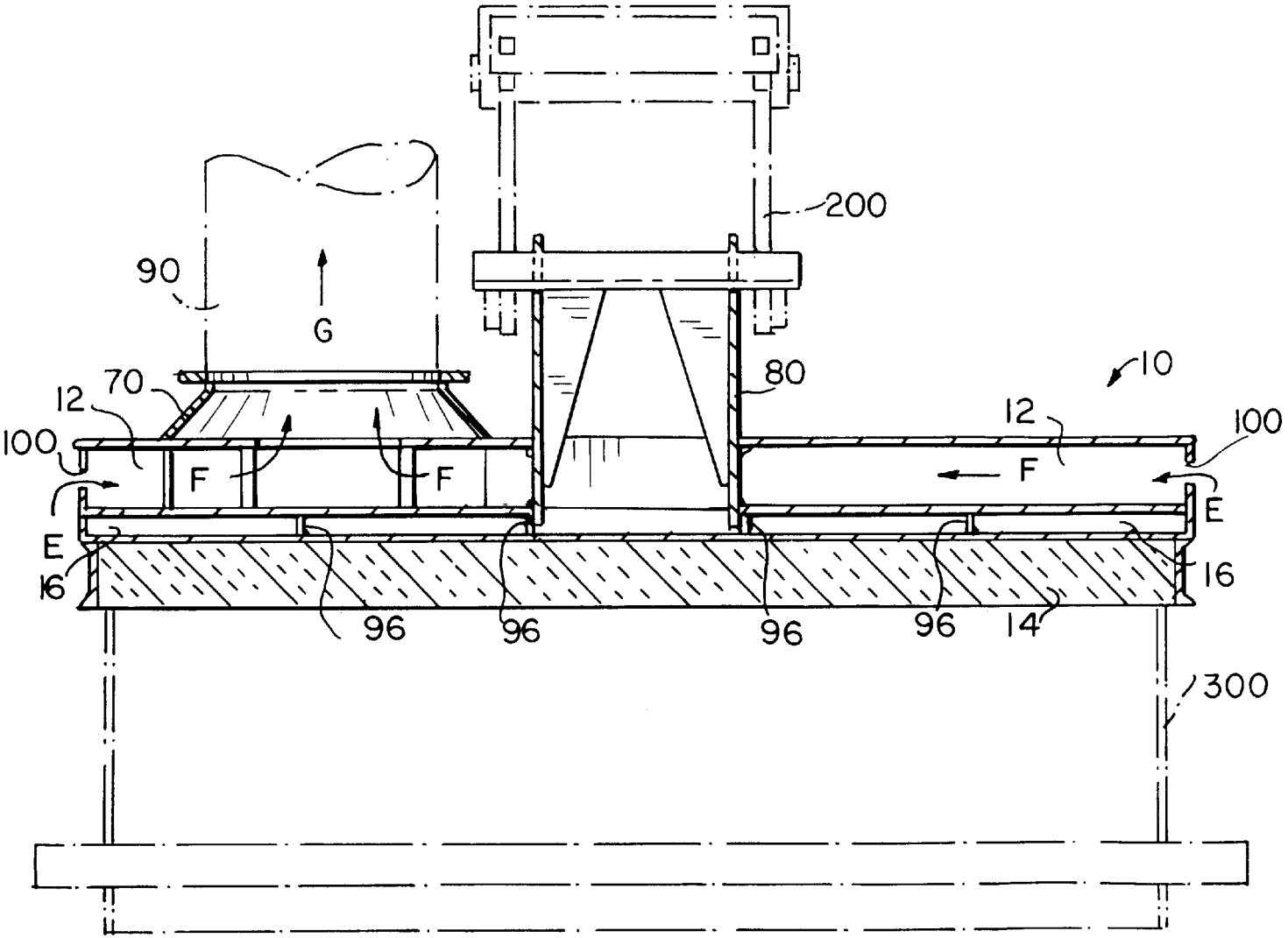
FIG. 6 is a cross-sectional view of the preferred embodiment cover depicted in FIG. 5, illustrating the interior configuration of the cover and airflow through the cover.

FIG. 6 is a cross-sectional view of the preferred embodiment cover 10. FIGS. 6 and 1A further illustrate the fame collecting region 12 and the heat insulating layer 14 provided in the cover 10. The heat insulating layer 14 is preferably disposed proximate the lower planar member 20 and adjacent to the outer face 22 of the lower planar member 20. The heat insulating layer 14 serves to promote the retention of thermal energy within the vessel or container upon which the cover 10 is disposed. That is, the heat insulating layer 14 assists in reducing heat loss from the vessel or container, such as when the vessel contains molten steel. The heat insulating layer 14 is preferably formed from a high temperature refractory material. It is most preferred to utilize a high temperature ceramic fiber refractory material for the heat insulating layer 14.

FIG. 6 illustrates the fume collection feature of the preferred embodiment cover 10. Air or fumes are drawn from the upper periphery of the vessel or container through the interior of the cover 10, and specifically through the fume collecting region 12, upon connection between the shroud 70 and the venting duct 90 providing a vacuum source. Specifically, the flow of air or fumes is as follows. Fumes residing or emitted around the upper portion of the ladle, such as between the cover 10 and the ladle 300, are drawn into the cover 10 through the inlet openings 100. This flow is illustrated in FIGS. 1A and 6 by arrows E. The fumes or other gases are drawn through the fume collecting region 12, toward the shroud 70, denoted by arrows F. The fumes are then drawn into the shroud 70 and flow to the venting duct 90, depicted by arrow G. As noted in the description of FIGS. 1 and 1A, the support bracket 60 disposed proximate to the shroud 70 and within the fame collecting region 12, preferably defines a plurality of inlet apertures 62 that facilitate the passage of fumes through the fume collecting region 12 to the shroud 70.

As best illustrated in FIGS. 1A and 6, the secondary heat transfer barrier 16 is defined between the lower face 27 of the interior planar member 26 and the inner face 21 of the lower planar member 20. The secondary heat transfer barrier 16 is primarily an air space within which are disposed the plurality of ribs 96 and 98. The secondary heat transfer barrier 16 serves to minimize transfer of heat from the lower region of the cover 10, such as along the heat insulating layer 14, to the upper region of the cover 10, such as the fume collection region 12 and along the upper planar member 30.

It will be appreciated that the present invention encompasses numerous other cover configurations than that of the preferred embodiment cover 10 described herein. For example, the present invention includes a cover having a circular shape when viewed in planar fashion, and having the previously described fume collecting region, heat insulating layer, and secondary heat transfer barrier. Furthermore, the present invention includes other accessory equipment configurations besides the particular lift bracket and shroud disclosed herein.

The preferred embodiment cover 10 is constructed from any suitable grade of steel or other acceptable material. The cover and its components are secured and affixed to one another by welding, typically. The heat insulating material is incorporated into the cover by techniques known to those skilled in the art.

The present invention cover will find wide application. However, the cover 10 is believed to be particularly well suited for use in the steelmaking arts, and specifically, in the production of leaded steel.

The present invention has been described with reference to the preferred embodiment ladle cover 10. Obviously, modifications and alternations will occur to others upon a reading and understanding of the preceding detailed description. It is intended that the invention be construed as including all such modifications and alternations insofar as they come within the scope of the appended claims or the equivalents.

What is claimed is:

1. A ladle cover adapted for collecting fumes from the exterior of said cover, said cover comprising:

an upper member, said upper member defining a first aperture;

a lower member spaced from said upper member;

a sidewall extending between said upper member and said lower member; said sidewall defining a plurality of second apertures, wherein said second apertures are spaced apart from one another along the exterior of said cover in said sidewall; and a heat insulating layer disposed proximate to said lower member.

2. The ladle cover of claim 1 wherein said lower member defines an inner face directed toward said upper member, and an outer face oppositely directed from said inner face, and said heat insulating layer is disposed adjacent to said outer face.

3. The ladle cover of claim 1 further comprising:

an outwardly extending shroud, said shroud extending from said upper member, said shroud disposed over said first aperture.

4. The ladle cover of claim 1 wherein said second apertures in said sidewall are spaced apart from one another along the exterior of said cover such that when a vacuum source is attached at said first aperture of said upper member, outside air, including fumes and gases along the exterior of said cover, is drawn into said second apertures, into said cover, and exhausted through said first aperture.

5. The ladle cover of claim 1 further comprising:

a lift bracket secured to said cover and extending from said upper member, said lift bracket disposed over the center of gravity of said cover.

6. The ladle cover of claim 1 wherein said upper member and said lower member are generally planar.

7. The ladle cover of claim 6 wherein said upper member is generally parallel to said lower member.

8. The ladle cover of claim 6 wherein said sidewall is transversely oriented to at least one of said upper member and said lower member.

9. A cover for use with a metallurgical vessel, said cover comprising:

a first planar member defining a first aperture;

a second planar member spaced from and generally parallel to said first planar member;

a third planar member disposed between said first planar member and said second planar member, said third planar member spaced from and generally parallel to both said first and second planar members, thereby defining a fume collecting region between said first planar member and said third planar member;

a sidewall extending between said first planar member and said second planar member, said sidewall defining a second aperture, said first aperture and said second aperture providing access to said fume collecting region; and a heat insulating layer disposed proximate to said second planar member.

10. The cover of claim 9 wherein said sidewall is transversely oriented with respect to at least one of said first planar member and said second planar member.

11. The cover of claim 9 further comprising:

a shroud extending from said first planar member and disposed over said first aperture.

12. The cover of claim 9 further comprising:

a lift bracket extending from at least one of said first planar member, said second planar member, and said third planar member, said lift bracket disposed over the center of gravity of said cover.

13. The cover of claim 9 further comprising:

a plurality of ribs disposed between said second planar member and said third planar member.

14. The cover of claim 9 wherein said heat insulating layer comprises a refractory material.

15. The cover of claim 14 wherein said refractory material comprises a high temperature ceramic fiber refractory material.

16. A method for collecting fumes from a metallurgical vessel having an open top region from which said fumes are emitted, said method comprising:

providing a cover comprising (i) an upper member, said upper member defining a first aperture, (ii) a lower member generally spaced from said upper member, (iii) a sidewall extending between said upper member and said lower member, said sidewall defining a second aperture, said upper member, said lower member, and said sidewall defining an interior region, and (iv) a heat insulating layer disposed proximate to said lower member;

placing said cover over said open top of said vessel; and connecting a vacuum source to said cover at said first aperture defined in said upper member, whereby upon application of said vacuum source to said cover, fumes from said vessel are drawn through said second aperture defined in said sidewall, into said interior region of said cover, and through said first aperture defined in said upper member.

17. A ladle cover adapted for collecting fumes from the exterior of said cover, said cover comprising:

an upper member, said upper member defining a first aperture;

a lower member spaced from said upper member;

an upper sidewall extending between said upper member and said lower member; said sidewall defining a second aperture;

a heat insulating layer disposed proximate to said lower member; and a lower sidewall extending away from the lower member and approximately equal to the thickness of the heat insulating layer.

18. The ladle cover of claim 17 wherein said lower member defines an inner face directed toward said upper member, and an outer face oppositely directed from said inner face, and said heat insulating layer is disposed adjacent to said outer face.

19. The ladle cover of claim 17 further comprising:

an outwardly extending shroud, said shroud extending from said upper member, said shroud disposed over said first aperture.

20. The ladle cover of claim 17 wherein said upper sidewall defines a plurality of said second apertures, wherein said second apertures are spaced apart from one another along the exterior of said cover.

21. The ladle cover of claim 17 further comprising:

a lift bracket secured to said cover and extending from said upper member, said lift bracket disposed over the center of gravity of said cover.

22. The ladle cover of claim 17 wherein said upper member and said lower member are generally planar.

23. The ladle cover of claim 22 wherein said upper member is generally parallel to said lower member.

24. The ladle cover of claim 22 wherein said sidewall is transversely oriented to at least one of said upper member and said lower member.

25. A ladle cover adapted for collecting fumes from the exterior of said cover, said cover comprising:

an upper member, said upper member defining a first aperture;

a lower member spaced from said upper member;

a sidewall extending between said upper member and said lower member; said sidewall defining a second aperture;

a heat insulating layer disposed proximate to said lower member;

a secondary heat transfer barrier between said upper member and said lower member, disposed proximate to said lower member; and a fume collecting region between said upper member and said lower member, disposed proximate to said upper member.

26. The ladle cover of claim 25 wherein said lower member defines an inner face directed toward said upper member, and an outer face oppositely directed from said inner face, and said heat insulating layer is disposed adjacent to said outer face.

27. The ladle cover of claim 25 further comprising:

an outwardly extending shroud, said shroud extending from said upper member, said shroud disposed over said first aperture.

28. The ladle cover of claim 25 wherein said sidewall defines a plurality of said second apertures, wherein said second apertures are spaced apart from one another along the exterior of said cover.

29. The ladle cover of claim 25 further comprising:

a lift bracket secured to said cover and extending from said upper member, said lift bracket disposed over the center of gravity of said cover.

30. The ladle cover of claim 25 wherein said upper member and said lower member are generally planar.

31. The ladle cover of claim 30 wherein said upper member is generally parallel to said lower member.

32. The ladle cover of claim 30 wherein said sidewall is transversely oriented to at least one of said upper member and said lower member.

* * * * *